US009104161B2

(12) United States Patent
Hori et al.

(10) Patent No.: US 9,104,161 B2
(45) Date of Patent: Aug. 11, 2015

(54) RECORDING MEDIUM STORAGE APPARATUS AND IMAGE FORMING APPARATUS THEREWITH

(71) Applicant: KYOCERA Document Solutions Inc., Osaka (JP)

(72) Inventors: Toshio Hori, Osaka (JP); Yoshio Sugishima, Osaka (JP); Yoshiaki Tashiro, Osaka (JP); Hideaki Doyo, Osaka (JP); Noriko Masuta, Osaka (JP); Hiroaki Takai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/522,231

(22) Filed: Oct. 23, 2014

(65) Prior Publication Data

US 2015/0117928 A1 Apr. 30, 2015

(30) Foreign Application Priority Data

Oct. 25, 2013 (JP) ..... 2013-222102

(51) Int. Cl.
*G03G 15/00* (2006.01)

(52) U.S. Cl.
CPC ..... *G03G 15/6502* (2013.01)

(58) Field of Classification Search
CPC ..... B65H 2405/121
USPC ..... 399/393
See application file for complete search history.

(56) References Cited

U.S. PATENT DOCUMENTS

| | | | | |
|---|---|---|---|---|
| 5,292,116 | A * | 3/1994 | Inoue et al. | 271/157 |
| 7,469,892 | B2 * | 12/2008 | Iwase et al. | 271/164 |
| 8,061,707 | B2 * | 11/2011 | Sugishima | 271/164 |
| 8,794,619 | B2 * | 8/2014 | Yoshimura | 271/162 |
| 8,960,644 | B2 * | 2/2015 | Aoyama | 251/331 |
| 2008/0180764 | A1 * | 7/2008 | Wakiyama et al. | 358/498 |
| 2013/0032996 | A1 * | 2/2013 | Kubota et al. | 271/264 |

FOREIGN PATENT DOCUMENTS

JP U 61-41097 3/1986

* cited by examiner

*Primary Examiner* — Anthony Nguyen
(74) *Attorney, Agent, or Firm* — Stein IP, LLC

(57) ABSTRACT

A recording medium storage apparatus has a storage cassette and a lock mechanism. The lock mechanism restricts movement of the storage cassette in the drawing direction. The lock mechanism has an engaging portion on an apparatus body and an engaged portion on the storage cassette. While the storage cassette is drawn out of the apparatus body, an abutting portion of the engaging portion moves along a first slope on the engaged portion toward a peak portion while swinging in a second direction in which it retracts from the engaged portion, and meanwhile the engaged portion rotates in a third direction so that the peak portion is displaced from a protruding position to a guiding position.

5 Claims, 4 Drawing Sheets

RECORDING MEDIUM STORAGE APPARATUS AND IMAGE FORMING APPARATUS THEREWITH

INCORPORATION BY REFERENCE

This application is based upon and claims the benefit of priority from the corresponding Japanese Patent Application No. 2013-222102 filed on Oct. 25, 2013, the entire contents of which are incorporated herein by reference.

BACKGROUND OF THE INVENTION

The present disclosure relates to a recording medium storage apparatus that includes a storage cassette for storing a recording medium and a lock mechanism for restricting movement of the storage cassette in the drawing direction, and to an image forming apparatus that is provided with such a recording medium storage apparatus.

Conventionally, there have been widely used storage cassettes for storing a plurality of sheets of paper (recording medium) in a stack and for feeding them to an image forming section in the body of an image forming apparatus according to its image forming operation. An image forming apparatus is provided with a lock mechanism to restrict movement of a storage cassette in the drawing direction while the storage cassette is inserted in the body of the image forming apparatus.

In one example of a conventional image forming apparatus, the lock mechanism includes a locking member (engaging portion) provided on the apparatus body and a convex portion (engaged portion) provided on the storage cassette to be engaged with the engaging portion. The locking member is biased downward by a spring or the like and, during insertion of the storage cassette, rides over and engages with the convex portion. Now, for the storage cassette to move in the drawing direction, the locking member has to ride back over the convex portion against the biasing force. In this way, movement of the storage cassette in the drawing direction is restricted.

SUMMARY OF THE INVENTION

According to one aspect of the present disclosure, a recording medium storage apparatus is provided with a storage cassette and a lock mechanism. The storage cassette is insertable into and drawable out of an apparatus body, and stores a recording medium. The lock mechanism restricts movement of the storage cassette in the drawing direction while the storage cassette is inserted in the apparatus body. The lock mechanism includes an engaging portion, an engaged portion, and a first biasing member. The engaging portion is provided on the apparatus body, is pivoted in one end portion on a first rotation axis extending in a direction crossing the drawing/insertion direction of the storage cassette, and has in the other end portion a swingable abutting portion. The engaged portion is provided on the storage cassette, is supported on a second rotation axis extending parallel to the first rotation axis so as to be rotatable between a protruding position and a guiding position, and is engaged with the engaging portion when the storage cassette is in an inserted position. The first biasing member biases the engaging portion in a first direction in which it engages with the engaged portion. The engaged portion, in the protruding position, has a peak portion located opposite the engaging portion and a first slope located on the downstream side of the peak portion with respect to the drawing direction and inclined downward in the drawing direction. While the storage cassette is drawn out of the apparatus body, the abutting portion of the engaging portion moves along the first slope toward the peak portion while swinging in a second direction in which it retracts from the engaged portion, and meanwhile the engaged portion, by being pressed by the abutting portion, rotates in a third direction in which the peak portion moves in the insertion direction of the storage cassette so that the peak position is displaced from the protruding position to the guiding position.

Further features and advantages of the present disclosure will become apparent from the description of embodiments given below.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Embodiments of the present disclosure will be described below with reference to the accompanying drawings.

Figure 1:
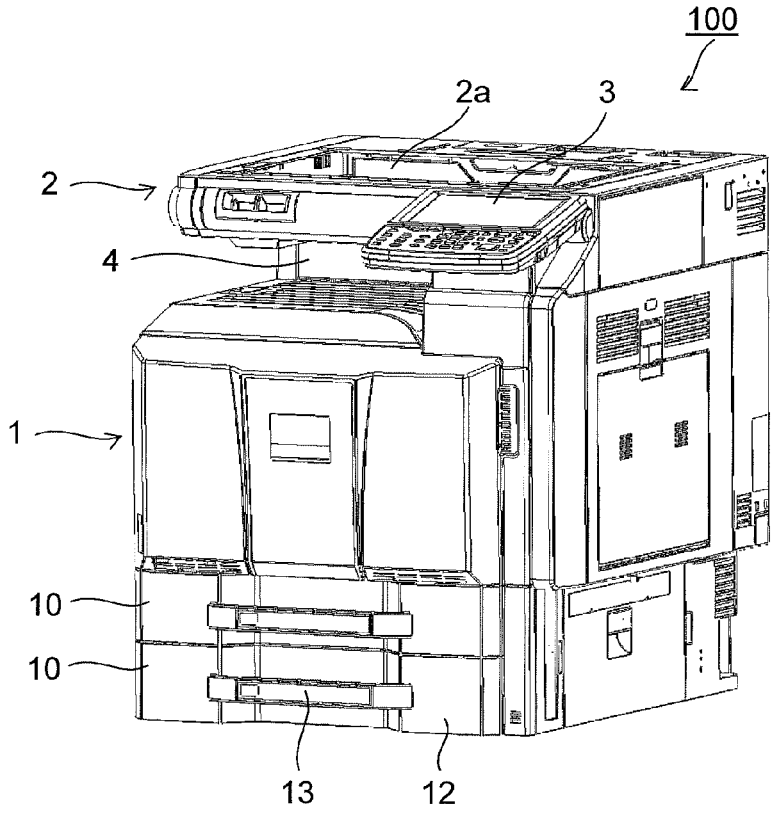
FIG. 1 is a perspective view showing a construction of an image forming apparatus provided with a recording medium storage apparatus according to one embodiment of the present disclosure.

With reference to FIGS. 1 to 7, an image forming apparatus 100 provided with a recording medium storage apparatus according to one embodiment of the present disclosure will be described. As shown in FIG. 1, the image forming apparatus 100 includes an apparatus body (image forming apparatus main body) 1 and an image reading device 2 arranged on top of it.

Inside the image reading device 2, an image reading section for reading image information from a document placed on a contact glass 2*a* is provided. The image reading section is composed of a scanning optical system including a scanner lamp for illuminating the document during copying and a mirror for deflecting the optical path of the light reflected from the document; a condenser lens for condensing and imaging the light reflected from the document; and a CCD sensor or the like for converting the imaged image light into an electrical signal. The image reading section thus reads a document image and converts it into image data.

In a front part of the image reading device 2, an operation panel 3 is provided which has operation buttons and a display. In a top part of the image reading device 2, a platen (not illustrated) for pressing the document placed on the contact glass 2*a* is provided as to be swingable between an open state and a closed state. The platen can be fitted with an automatic document transport device (not illustrated) for automatically feeding one sheet after another from a stack of document sheets successively onto the contact glass 2*a*.

Between the image reading device 2 and the apparatus body 1, an in-body paper discharge space 4 is provided which is wide open toward the left side and toward the front.

In a front part of the apparatus body 1, a plurality of (here, two) paper feed cassettes (storage cassettes) 10 for storing sheets of paper (recording medium) are provided so as to be insertable into and drawable out of the apparatus body 1.

Inside the apparatus body 1, there are provided an image forming section, a fusing section, a paper transport section, etc., of which none is illustrated. The image forming section forms an image by transferring a toner image to paper fed to it based on image data read by the image reading device 2. The image forming section includes a photosensitive drum for carrying an electrostatic latent image; a charger unit for electrically charting the surface of the photosensitive drum; an exposure unit for forming an electrostatic latent image corresponding to a document image on the surface of the photosensitive drum by means of a laser beam or the like; a developing unit for forming a toner image by attaching developer to the electrostatic latent image formed; a transfer roller for transferring the toner image to paper; a cleaning blade for removing toner that remains on the surface of the photosensitive drum; etc. The fusing section applies heat and pressure to the paper having the toner image transferred to it, and thereby fuses the toner image to the paper. The paper transport section extends upward along the right side face of the apparatus body 1, and transports paper from the paper feed cassettes 10 to the image forming section.

Inside the apparatus body 1, a lock mechanism 20 (see FIG. 2) is provided. While a paper feed cassette 10 is inserted in the apparatus body 1, the lock mechanism 20 restricts movement of the paper feed cassette 10 in the drawing direction (in FIG. 2, direction B). A paper feed cassette 10 and a lock mechanism 20 together constitute a recording medium storage apparatus according to the present disclosure.

Next, the structure of the paper feed cassette 10 and the lock mechanism 20 will be described.

Figure 2:
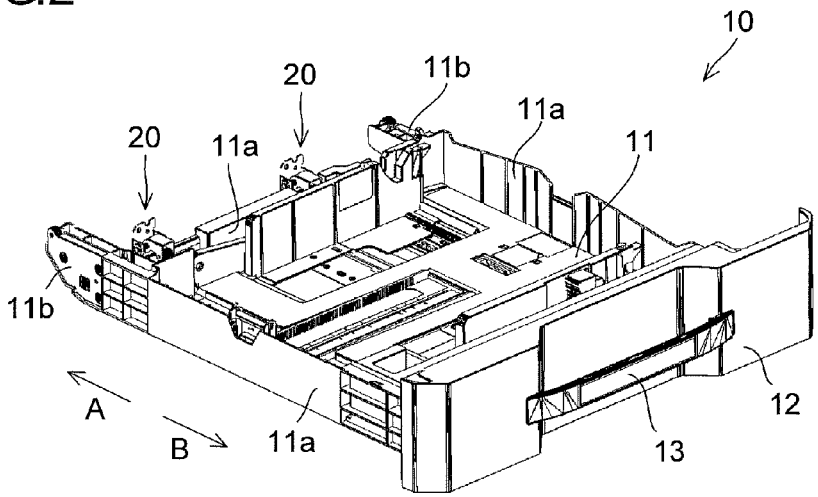
FIG. 2 is a perspective view showing a structure of a paper feed cassette in a recording medium storage apparatus according to one embodiment of the present disclosure.
Figure 3:
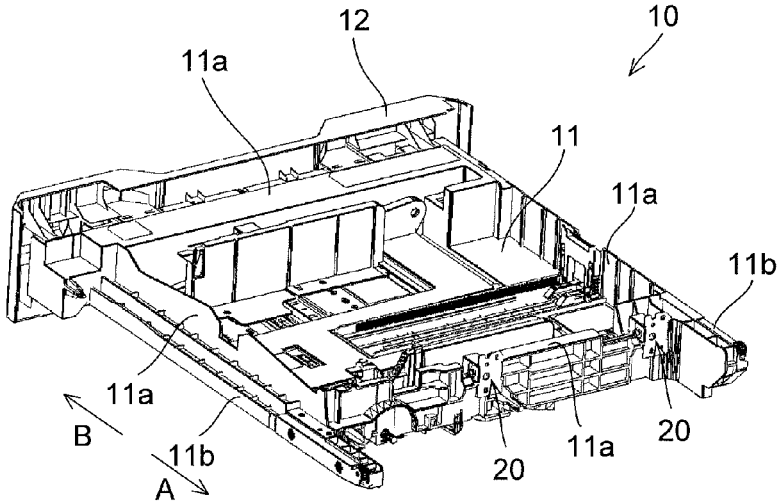
FIG. 3 is a perspective view showing a structure of a paper feed cassette in a recording medium storage apparatus according to one embodiment of the present disclosure.

As shown in FIG. 2, the paper feed cassette 10 has a storage portion 11 for storing paper, an outer cover 12 fastened to the storage portion 11, and a handle portion 13 provided on the outer cover 12. The storage portion 11 has, around its four sides, upright walls 11*a*. The storage portion 11 forms the housing (casing) of the paper feed cassette 10. The storage portion 11 is also provided with a pair of guide rails 11*b* which slide on a slide portion (not illustrated) provided on the apparatus body 1.

The outer cover 12 is fastened to the wall 11*a* located on the upstream side with respect to the insertion direction (direction A) of the paper feed cassette 10. The outer cover 12 is exposed outside, and forms part of the exterior faces of the image forming apparatus 100.

On the other hand, the wall 11*a* located on the downstream side with respect to the insertion direction of the paper feed cassette 10 is provided with two convex portions 14 (engaged portions; see FIG. 4) which constitute the lock mechanism 20. The convex portions 14 are formed so as to be rotatable about a rotation axis 14*d* (a second rotation axis) of an axis portion (not illustrated) pivoted on the walls 11*a*. The rotation of the convex portions 14 is restricted by an unillustrated restricting portion between a state (protruding position) shown in FIG. 4 and a state (guiding position) shown in FIG. 7. The rotation axis 14*d* and a rotation axis 21*c*, which will be described later, are parallel to each other, and both extend in the direction perpendicular to the plane of FIG. 4 (the direction crossing the drawing/insertion direction of the paper feed cassette 10).

The convex portion 14 is formed in a shape convex upward. The convex portion 14 has a second slope 14*a* located on the downstream side (in FIG. 4, the right side) with respect to the insertion direction of the paper feed cassette 10 and a first slope 14*b* located on the upstream side (in FIG. 4, the left side) with respect to the insertion direction of the paper feed cassette 10.

While the paper feed cassette 10 is inserted into the apparatus body 1, a wheel 21*b* of a locking member 21, which will be described later, abuts on the second slope 14*a* of the convex portion 14, and moves along the second slope 14*a* toward a peak portion 14*c*. As a result, the convex portion 14 is acted on by a moment in the counter-clockwise direction, and is brought into the state (position) shown in FIG. 5 by the restricting portion. The locking member 21 is displaced upward. On the other hand, while the paper feed cassette 10 is drawn out of the apparatus body 1, the locking member 21 abuts on the first slope 14*b*, and the convex portion 14 rotates in the clockwise direction (a third direction) about the rotation axis 14*d* so as to be brought into the state shown in FIGS. 6 and 7. Simultaneously, the locking member 21 rotates in the clockwise direction about a rotation axis 21*c* (a first rotation axis), and is displaced upward. Incidentally, while the paper feed cassette 10 is inserted in the apparatus body 1, the convex portion 14 is in the state (protruding position) shown in Fig. 4. The convex portion 14 is biased in the counter-clockwise direction by a second biasing member (not illustrated) such as a torsion spring, and is, in the position shown in FIGS. 4 and 5, restricted by the restricting portion (not illustrated) so as not to rotate in the counter-clockwise direction. Biasing the convex portion 14 in the counter-clockwise direction helps prevent the paper feed cassette 10 from dropping out.

Figure 4:
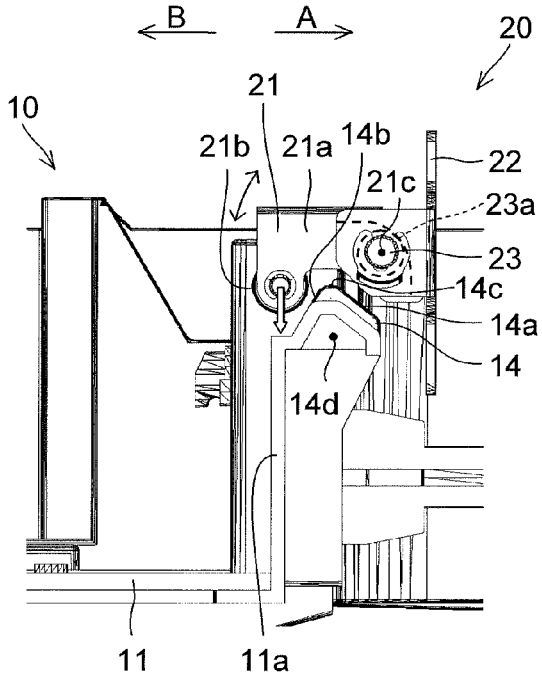
FIG. 4 is a sectional view showing a structure of and around a lock mechanism while a paper feed cassette is inserted in an apparatus body in a recording medium storage apparatus according to one embodiment of the present disclosure.
Figure 5:
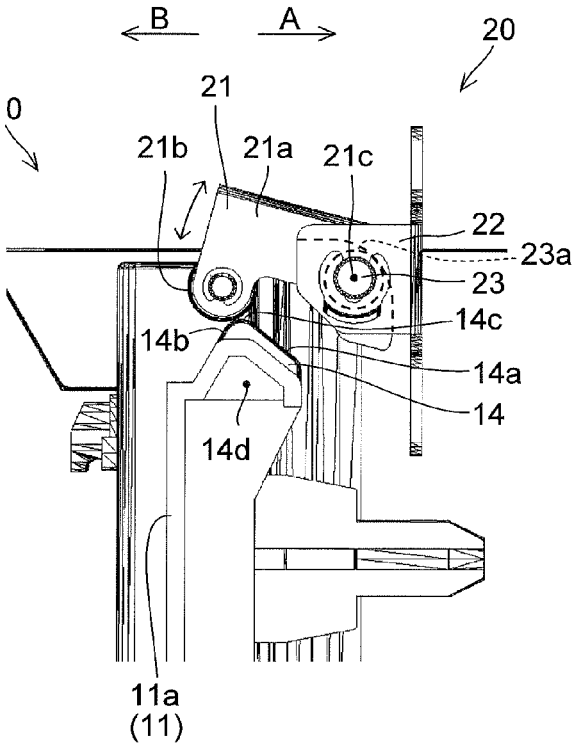
FIG. 5 is a sectional view showing a structure of and around a lock mechanism while a paper feed cassette is being inserted in an apparatus body in a recording medium storage apparatus according to one embodiment of the present disclosure.
Figure 6:
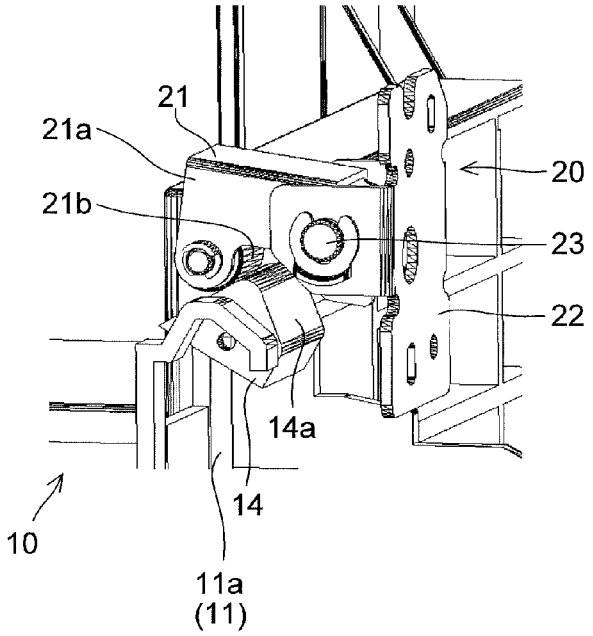
FIG. 6 is a perspective view showing a structure of and around a lock mechanism when a paper feed cassette starts to be drawn out of an apparatus body in a recording medium storage apparatus according to one embodiment of the present disclosure.

As shown in FIGS. 4 and 5, while the paper feed cassette 10 is inserted in the apparatus body 1, and while the paper feed cassette 10 is being inserted into the apparatus body 1, the inclination angle of the first slope 14*b* relative to the horizontal direction (the drawing/insertion direction of the paper feed cassette 10) is larger than the inclination angle of the second slope 14*a* relative to the horizontal direction. And the inclination angle of the first slope 14*b* relative to the horizontal direction (the drawing/insertion direction of the paper feed cassette 10) while the paper feed cassette 10 is being drawn out of the apparatus body 1 with the convex portion 14 rotated to the guiding position (the state shown in FIG. 7) is smaller than the inclination angle of the second slope 14*a* relative to the horizontal direction while the paper feed cassette 10 is inserted in the apparatus body 1 (the state shown in FIG. 4).

Moreover, while the paper feed cassette 10 is being drawn out of the apparatus body 1 with the convex portion 14 rotated to the guiding position (the state shown in FIG. 7), the inclination angle of the first slope 14*b* relative to the horizontal direction is smaller than the inclination angle of the second slope 14*a* relative to the horizontal direction. Thus, it is possible to give a steep (large) inclination angle to the second slope 14*a* while the paper feed cassette 10 is drawn out of the apparatus body 1. As a result, when the locking member 21 rides over the peak portion 14*c* of the convex portion 14 and then moves along the second slope 14*a*, the locking member 21 is acted on by a strong downward force, and this assists the drawing of the paper feed cassette 10.

The lock mechanism 20 includes, in addition to the convex portion 14, a locking member (engaging portion) 21 which rotates about the rotation axis 21*c* and a support member 22 which is formed out of sheet metal and on which the locking member 21 is pivoted. The support member 22 has a pair of support side faces which are bent in a U-shape as seen in a top view, and this pair of support side faces rotatably supports an axis portion 23, which will be described later. The support member 22 is fastened to the apparatus body 1 by means of a fastening member (not illustrated) such as screws.

The locking member 21 is biased in the counter-clockwise direction (a first direction) by a first biasing member 23*a*, such as a torsion spring, provided on the axis portion 23, which will be described later. The locking member 21 is displaced in the up/down direction (a direction along the first direction) to engage with the convex portion 14.

The locking member 21 is configured so as to be rotatable about the axis portion 23 supported on a bearing provided on the support member 22. The locking member 21 includes an arm portion 21 a which is formed out of sheet metal and a wheel 21*b* which is rotatably provided at an end of the arm portion 21 a and which abuts on the convex portion 14. The wheel 21*b* abuts, while rotating, on the convex portion 14, and this helps reduce the resistance encountered when the locking member 21 rides over the convex portion 14.

Next, a description will be given of how the convex portion 14 and the locking member 21 operate while the paper feed cassette 10 is inserted into the apparatus body 1 and while the paper feed cassette 10 is drawn out of the apparatus body 1.

While the paper feed cassette 10 is moved in direction A and is inserted into the apparatus body 1, the convex portion 14 is in the state shown in FIG. 5, and the locking member 21 abuts on the second slope 14*a* of the convex portion 14. The locking member 21 is thus displaced upward by the second slope 14*a*, and rides over the second slope 14*a*. Meanwhile, the convex portion 14 is held in the restricting position shown in FIG. 5, with the peak portion 14*c* of the convex portion 14 located at a high position. This increases the resistance encountered while the paper feed cassette 10 is drawn. Thus, the paper feed cassette 10 is locked so as not to move in its drawing direction (direction B).

Figure 7:
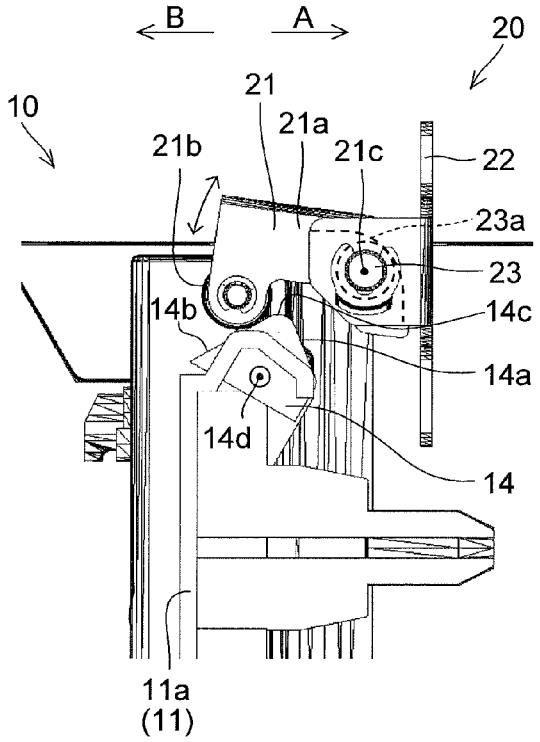
FIG. 7 is a sectional view showing a structure of and around a lock mechanism when a paper feed cassette starts to be drawn out of an apparatus body in a recording medium storage apparatus according to one embodiment of the present disclosure.

On the other hand, while the paper feed cassette 10 is drawn out of the apparatus body 1, the first slope 14*b* of the convex portion 14 is pressed rightward, as seen in FIG. 4, by the locking member 21, and thus the convex portion 14 rotates in the clockwise direction (a third direction) to be brought into the state shown in FIG. 7. The locking member 21 is then displaced above the first slope 14*b* of the convex portion 14, and rides over the first slope 14*b*. Thus, the lock mechanism 20 unlocks, and the paper feed cassette 10 is drawn out of the apparatus body 1.

Incidentally, the inclination angle of the first slope 14*b* relative to the horizontal direction when, as shown in FIG. 7, the convex portion 14 rotates in the clockwise direction (when the locking member 21 abuts on the first slope 14*b* while the paper feed cassette 10 is drawn out of the apparatus body 1) is smaller than the inclination angle of the second slope 14*a* relative to the horizontal direction when, as shown in FIG. 5, the locking member 21 abuts on the second slope 14*a* while the paper feed cassette 10 is inserted into the apparatus body 1, and this reduces the amount of upward swing (displacement) of the locking member 21 when it rides over the convex portion 14. That is, the amount of upward swing of the locking member 21 while the paper feed cassette 10 is drawn out of the apparatus body 1 is smaller than the amount of upward swing of the locking member 21 while the paper feed cassette 10 is inserted into the apparatus body 1.

In the embodiment, as described above, the locking member 21 provided on the apparatus body 1 is biased downward, and is displaced in the up/down direction to engage with the convex portion 14; on the other hand, the convex portion 14 is provided on the paper feed cassette 10, and rotates, while the paper feed cassette 10 is drawn out of the apparatus body 1, so as to reduce the amount of upward swing of the locking member 21. Thus, while the paper feed cassette 10 is drawn out of the apparatus body 1, the convex portion 14 rotates so as to reduce the amount of upward swing of the locking member 21. That is, it is possible to reduce the amount of swing by which the locking member 21 needs to be displaced against the biasing force. This helps reduce burden on the user, and thus helps improve the ease of drawing the paper feed cassette 10.

The embodiment does not help to reduce the resistance encountered by the user while inserting the paper feed cassette 10 into the apparatus body 1, but this does not count as a disadvantage because the user is unlikely to feel resistance while inserting the paper feed cassette 10. That is, during insertion, the paper feed cassette 10 is moved in the insertion direction, and thus the paper feed cassette 10 has been accelerated to some degree when the convex portion 14 collides with the locking member 21. Thus, the locking member 21 rides over the convex portion 14 without increasing the resistance to the user, and the paper feed cassette 10 is inserted into the apparatus body 1. On the other hand, during drawing of the paper feed cassette 10, the locking member 21 has to ride over the convex portion 14 immediately after the start of drawing (with the paper feed cassette 10 in an unaccelerated state), and this increases the resistance to the user, posing a problem. The present disclosure makes it possible to reduce the resistance to the user while drawing the paper feed cassette 10.

Moreover, as compared with a case where a release lever for unlocking the lock mechanism is provided on the handle portion of the paper feed cassette, there is no need to unlock the lock mechanism by manipulating a release lever while drawing the paper feed cassette out of the apparatus body, and this contributes to improved ease of drawing the paper feed cassette 10.

Moreover, as described above, the amount of upward swing of the locking member 21 while the paper feed cassette 10 is drawn out of the apparatus body 1 is smaller than the amount of upward swing of the locking member 21 while the paper feed cassette 10 is inserted into the apparatus body 1. Thus, it is possible to more easily reduce the burden on the user while drawing the paper feed cassette 10 out of the apparatus body 1 than while inserting the paper feed cassette 10 into the apparatus body 1.

Moreover, as described above, the inclination angle of the first slope 14*b* relative to the horizontal direction (the drawing/insertion direction of the paper feed cassette 10) while the paper feed cassette 10 is being drawn out of the apparatus body 1 with the convex portion 14 rotated to the guiding position (the state shown in FIG. 7) is smaller than the inclination angle of the second slope 14*a* relative to the horizontal direction while the paper feed cassette 10 is inserted in the apparatus body 1 (the state shown in FIG. 4). This makes it possible to easily reduce the burden on the user while drawing the paper feed cassette 10 out of the apparatus body 1.

It should be understood that the embodiments disclosed herein are in every aspect illustrative and not restrictive. The scope of the present disclosure is defined not by the description of the embodiments given above but by the appended claims, and encompasses any variations and modifications made within the sense and scope equivalent to those of the claims.

For example, although the embodiment described above deals with an example where one paper feed cassette is provided with two lock mechanisms, this is not meant to be any limitation: one paper feed cassette can be provided with one lock mechanism, or with three or more lock mechanisms.

Although the embodiment described above deals with an example where, while the paper feed cassette 10 is drawn, the convex portion 14 rotates in the third direction (clockwise direction) so as to reduce the resistance to the user, this is not meant to be any limitation: a structure is also possible that reduces the resistance to the user also while the paper feed cassette 10 is inserted. Specifically, a structure is possible where, while the paper feed cassette 10 is inserted into the apparatus body 1, the convex portion 14 rotates in a fourth direction (counter-clockwise direction) opposite to the third direction by being acted on by a pressing force of the locking member 21. With this structure, it is possible to reduce the resistance to the user also while the paper feed cassette 10 is inserted. In this case, a structure is possible where, when the insertion of the paper feed cassette 10 is complete, the convex portion 14 automatically returns to the position (protruding position) shown in FIG. 4.

What is claimed is:

1. A recording medium storage apparatus comprising:

a storage cassette for storing a recording medium, the storage cassette being insertable into and drawable out of an apparatus body; and a lock mechanism for restricting movement of the storage cassette in an drawing direction while the storage cassette is inserted in the apparatus body;

wherein the lock mechanism includes an engaging portion provided on the apparatus body, the engaging portion being pivoted in one end portion thereof on a first rotation axis extending in a direction crossing an drawing/insertion direction of the storage cassette, the engaging portion having in another end portion thereof a swingable abutting portion, an engaged portion provided on the storage cassette, the engaged portion being supported on a second rotation axis extending parallel to the first rotation axis so as to be rotatable between a protruding position and a guiding position, the engaged portion being engaged with the engaging portion when the storage cassette is in an inserted position, and a first biasing member for biasing the engaging portion in a first direction in which the engaging portion engages with the engaged portion, the engaged portion, in the protruding position, has a peak portion located opposite the engaging portion and a first slope located on a downstream side of the peak portion with respect to the drawing direction and inclined downward in the drawing direction, and while the storage cassette is drawn out of the apparatus body, the abutting portion of the engaging portion moves along the first slope toward the peak portion while swinging in a second direction in which the abutting portion retracts from the engaged portion, and meanwhile the engaged portion, by being pressed by the abutting portion, rotates in a third direction in which the peak portion moves in an insertion direction of the storage cassette such that the peak position is displaced from the protruding position to the guiding position.

2. The recording medium storage apparatus according to claim 1, wherein the engaged portion further has a second slope located on an upstream side of the peak portion with respect to the drawing direction and inclined downward in the insertion direction of the storage cassette, and while the storage cassette is inserted into the apparatus body, the abutting portion moves along the second slope toward the peak portion while swinging in the second direction in which the abutting portion retracts from the engaged portion, and meanwhile the engaged portion, by being pressed by the abutting portion, rotates in a fourth direction opposite to the third direction such that the peak portion is displaced from the guiding position to the protruding position.

3. The recording medium storage apparatus according to claim 1, wherein an amount of swing of the engaging portion in the second direction while the storage cassette is drawn out of the apparatus body is smaller than an amount of swing of the engaging portion in the second direction while the storage cassette is inserted into the apparatus body.

4. The recording medium storage apparatus according to claim 1, wherein an inclination angle of the first slope relative to the drawing/insertion direction of the storage cassette while the storage cassette is drawn out of the apparatus body with the engaged portion rotated to the guiding position is smaller than the inclination angle of the first slope while the storage cassette is inserted in the apparatus body.

5. An image forming apparatus comprising the recording medium storage apparatus according to claim 1.

* * * * *